United States Patent [19]

Röck et al.

[11] Patent Number: 4,803,749

[45] **Date of Patent: * Feb. 14, 1989**

[54] MOUNTING PLATE FOR A HINGE FOR MOUNTING A DOOR ON FURNITURE FRAMES OF VARYING THICKNESS

[75] Inventors: Erich Röck, Höchst; Helmut Rupprechter, Lauterach, both of Austria

[73] Assignee: Julius Blum Gesellschaft M.B.H., Höchst, Austria

[ * ] Notice: The portion of the term of this patent subsequent to Nov. 26, 2002 has been disclaimed.

[21] Appl. No.: 721,661

[22] Filed: Apr. 9, 1985

Related U.S. Application Data

[63] Continuation of Ser. No. 509,231, Jun. 28, 1983, Pat. No. 4,554,706.

[30] Foreign Application Priority Data

Jul. 8, 1982 [AT] Austria ..... 2666/82
Apr. 7, 1983 [AT] Austria ..... 1224/83

[51] Int. Cl.[4] ..... E05D 7/04

[52] U.S. Cl. ..... 16/237; 16/382

[58] Field of Search ..... 16/236, 237, 238, 243, 16/245, 246, 248, 382, 389, 390, 391; 403/190, 191, 237; 269/171, 254 R, 287

[56] References Cited

U.S. PATENT DOCUMENTS

| | | | |
|---|---|---|---|
| 737,199 | 8/1903 | Bonner | 269/171 X |
| 934,589 | 9/1909 | Bradford | 269/171 X |
| 1,782,615 | 11/1930 | Hopwood | 269/254 R X |
| 2,595,506 | 5/1952 | Backman | 16/246 X |
| 3,908,226 | 9/1975 | Read et al. | 16/237 |

*Primary Examiner*—Fred A. Silverberg
*Attorney, Agent, or Firm*—Wenderoth, Lind & Ponack

[57] ABSTRACT

A hinge mounting plate suitable for fastening to a furniture frame is U-shaped and is laterally slideable onto the furniture frame. A distance compensating plate is provided at one of the two parallel side flanges of the mounting plate.

3 Claims, 4 Drawing Sheets

MOUNTING PLATE FOR A HINGE FOR MOUNTING A DOOR ON FURNITURE FRAMES OF VARYING THICKNESS

BACKGROUND OF THE INVENTION

This is continuing application of Ser. No. 509,231, filed June 28, 1983, now U.S. Pat. No. 4,554,706.

The invention relates to a mounting plate for use in mounting a hinge on a frame of a piece of furniture, the hinge to support a door. The mounting plate is attached to the side of the frame for supporting a hinge arm and a hinge casing or the like, the hinge arm and hinge casing being connected to one another by means of a hinge axle or hinge axles and hinge links. At least one fastening screw fastens the mounting plate to the frame.

In modern furniture construction, so-called door frames are used, such frames carrying the hinges for the door, and the actual side walls of the furniture body are made of a weaker material. This has the advantages that the total cost of the piece of furniture can be reduced, because the side walls may be extremely thin, and that the side walls can be made of materials of better quality and more attractive outward appearance without increasing the cost of the pieces of furniture when compared with conventionally manufactured pieces of furniture. This new type of furniture construction creates new problems with respect to the mounting of the hinges, and extra frame hinges have, therefore, been developed.

It is still difficult to fix the relatively heavy door to the narrow frame in such a way that even after a period of time no lowering or tilting of the door occurs, i.e. that the hinge base plate on which all forces from the furniture door act is securely fastened to the frame.

SUMMARY OF THE INVENTION

It is the object of the invention to provide a mounting plate of the afore-described type by means of which a hinge may be safely secured to a frame and which can adapt to frames of irregular or varying widths.

According to the invention this is achieved by constructing the mounting plate to embrace the frame in the form of a U, a hinge arm being mounted on one of two parallel side flanges of the U-shaped mounting plate and the other side flange having a distance compensating plate which abuts against the frame.

It is advantageously provided that the distance compensating plate rests resiliently against the frame. A mounting plate of this type can be easily pushed onto the frame to embrace the frame snugly.

An embodiment of the invention provides that the distance compensating plate is formed integrally with the mounting plate and that a separating slot is provided at an edge between the the respective side flange of the mounting plate and the center flange of the mounting plate.

Mounting of the mounting plate, i.e. pushing thereof onto the frame, is facilitated by providing a projection on the distance compensating plate directed towards the side of the frame.

To permit a vertical adjustment of the mounting plate and, hence of the hinge, a preferred embodiment provides that the fastening screw protrudes through a slot, in the center flange of the mounting plate, such slot extending vertically in the mounted position.

It is a further object of the invention to provide a mounting plate of the afore-mentioned type which is held firmly on the frame, with a vertical adjustment of the mounting plate possible after a member is fixed to the frame at a starting position, thereby to facilitate mounting of the hinge.

According to the invention this is achieved by adapting the mounting plate to embrace the frame in the shape of a U, such that the hinge may be fastened generally to the frame and will be prevented from tilting, the hinge arm preferably being mounted on one of the two parallel side flanges of the U-shaped mounting plate and the mounting plate having a slot in the center flange for the fastening screw, and by providing a two-part base plate to be received in the U-shaped profile of the mounting plate and having a centering member which has a slot for the fastening screw and a sliding member retained at the mounting plate and moveable with the mounting plate with respect to the centering member in the direction of the slot, the sliding member and the centering member having intermediately arranged locking means, which can be overcome by hand.

Due to the arrangement of a two part base plate, which is advantageously injection-molded of plastic material with the centering member retained in the sliding member, and due to the slot in the centering member through which the fastening screw extends, a zero or starting position for the mounting plate and for the hinge with respect to the height of the piece of furniture can be defined. This means that the exact position of the mounting plate and of the hinge need not be determined each time a hinge is mounted. If a height adjustment is required, however, the mounting plate and the sliding member can be displaced along the centering member in the direction of the height of the piece of furniture over the length of the slot in the sliding member. It is advantageously provided that the sliding member has a rectangular aperture in which the centering member is received. Due to the fact that the sliding member receives the centering member, good central guiding of the assembly of the mounting plate, sliding member centering member is obtained.

Advantageously the locking or guiding means for the zero position are formed by a projection on the sliding member extending into a notch in the centering member, or vice versa. Particularly when the sliding member and the centering member are of plastic material the sliding member can, if a vertical adjustment is required, be displaced by hand by forcing the projection out of the notch.

An advantageous embodiment for locking the mounting plate in position provides that the sliding member has a slot within which one of the side flanges of the mounting plate is held by positive locking.

To ensure a close fit of the mounting plate, a further advantageous embodiment provides that the sliding member has a flange resting against a side face of the frame in the mounted position and having preferably one projection pressing on such frame face, such on side flange of the mounting plate being inserted into a slot in the flange of the sliding member.

To ensure that the base plate comprising the centering member and the sliding member does not fall off the mounting plate during mounting operations, advantageously at least one holding projection extends from the inserted side flange of the mounting plate into a corresponding recess in the sliding member.

One embodiment which has proved advantageous in view of manufacturing techniques provides that the centering member and the sliding member are together injection-molded of plastic material and superjacently retained by means of connecting flanges forming desired breaking points. When the centering member and the sliding member are to be mounted, the centering member is pressed into the sliding member and the connecting flanges are broken, e.g. when the mounting plate is pressed against the frame.

BRIEF DESCRIPTION OF THE DRAWINGS

In the following description, embodiments of the invention will be described in more detail with reference to the accompanying drawing in which.

DETAILED DESCRIPTION OF THE INVENTION

In this description there are no details regarding the hinge parts at the side of the door, i.e. the hinge casing or a hinge blade, which may be provided, as well as the hinge links and the hinge arm, as they may be designed according to the state of the art. The design according to the invention relates to the fastening of the mounting plate which carries the hinge arm.

Figure 6:
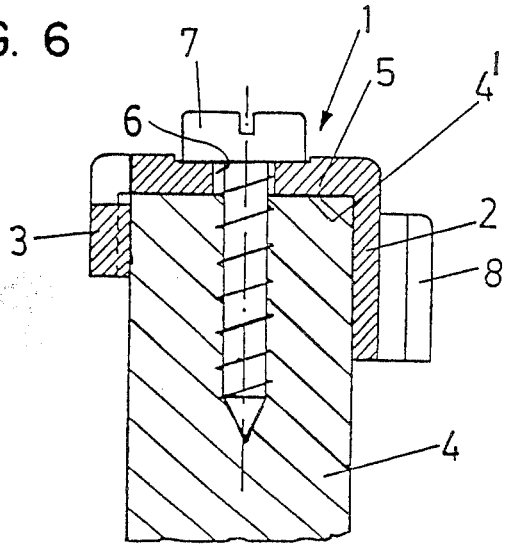
FIG. 6 is a sectional view along line VI—VI of FIG. 4.
Figure 7:
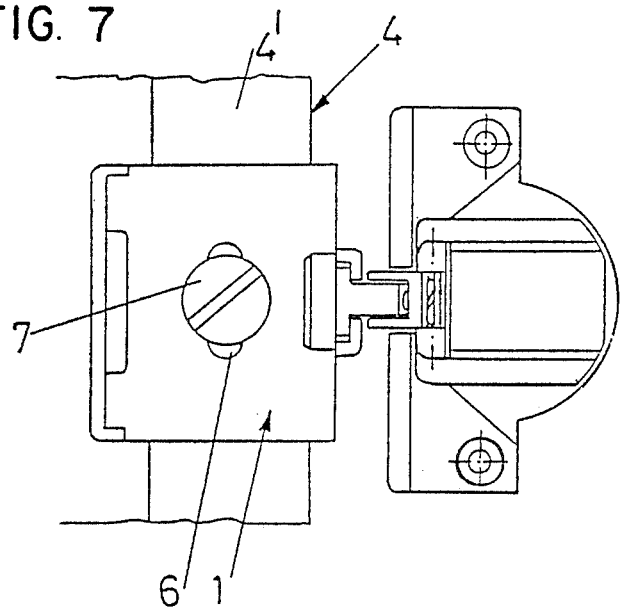
FIG. 7 is a schematic top view of a hinge in the open position.

As can be seen in FIG. 6, a mounting plate 1 is U-shaped and embraces with its two side flanges 2, 3 a frame 4 in the mounted position. A center flange 5 of the mounting plate 1 lies on the front face 4' of a frame 4.

A slot 6 extending vertically in the mounted position is provided in the center flange 5 of the mounting plate 1, a fastening screw 7 protruding through slot 6.

Holding flanges 8 are provided on the side flange 2 of the mounting plate 1, which flange is the external one in the mounted position, and a hinge arm is adapted to be pushed into holding flanges 8. The hinge arm is preferably held by conventional clamping screws.

A distance compensating plate 9 according to the invention is provided at the side flange 3 which is arranged internally of the piece or article of furniture and lies opposite the side flange 2 which carries the hinge arm. In the embodiment according to FIGS. 2 to 6 the distance compensating plate 9 is formed integrally with the side flange 3 of mounting plate 1 and is separated from the remainder of mounting plate 1 by a separating slot 10 at the edge between the side flange 3 and the center flange 5.

Figure 1:
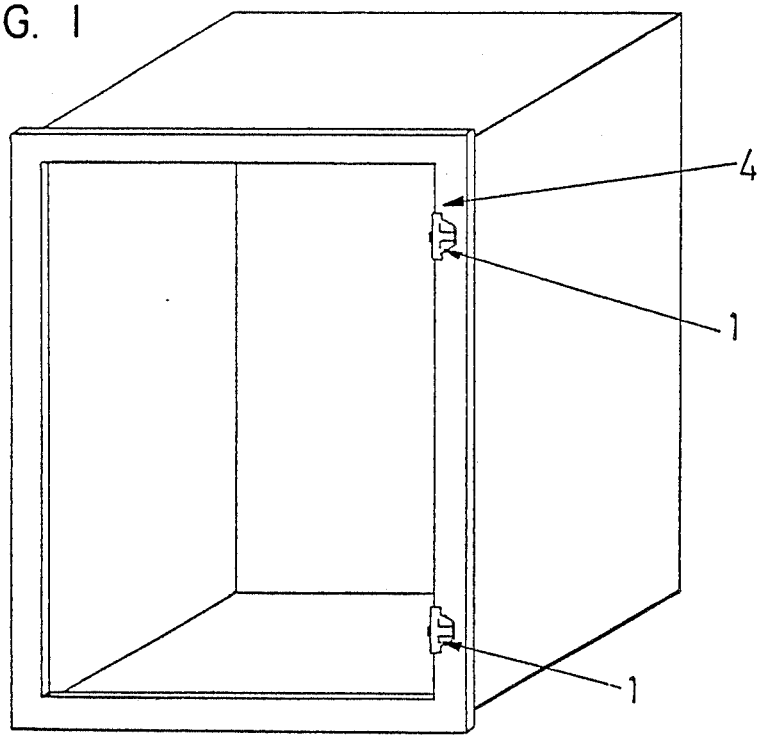
FIG. 1 is a schematic view of a piece of furniture with which a hinge and a mounting plate according to the invention are used.
Figure 2:
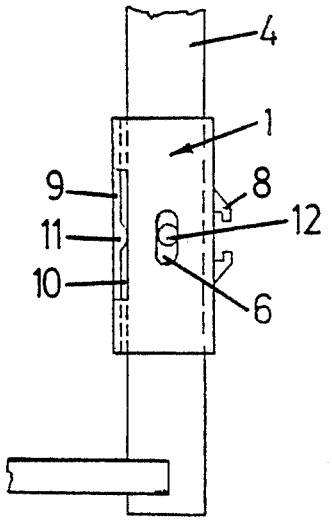
FIGS. 2 and 3 are top views of a mounting plate which is simply pushed onto a furniture frame before final mounting.
Figure 3:
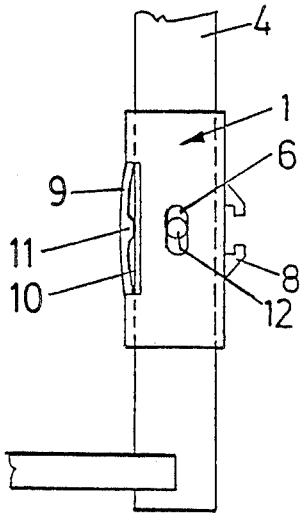
Figure 4:
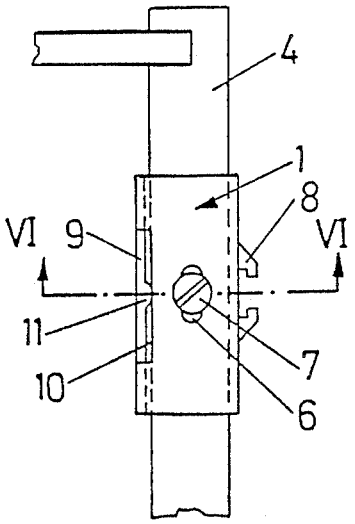
FIGS. 4 and 5 are similar top views of the mounting plate in the final mounting position.
Figure 5:
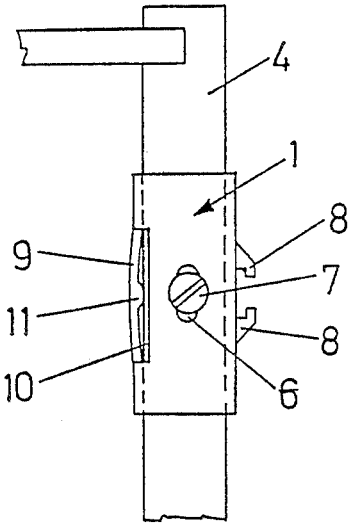

The distance compensating plate 9 is made of a resilient workable material so that the plate can be bent from the position illustrated in FIGS. 2 and 4 into the position illustrated in FIGS. 3 and 5, when the mounting plate 1 is pushed onto the frame 4, depending on the thickness of the particular frame 4. To facilitate pushing of the mounting plate 1 onto the frame 4, a projection 11 is provided at the inner portion of plate 9.

For mounting, the mounting plate 1 is first, as shown in FIGS. 2 and 3, pushed onto the frame 4, such that mounting plate 1 then is clamped in position because the two side flanges 2,3 and the distance compensating plate 9 with its projections 11 fit snugly at the frame 4. When used with a thicker frame 4, the distance compensating plate 9 is pushed outwardly, as illustrated in FIGS. 3 and 5.

Before the mounting plate 1 is fixed on the frame, a hole 12 for the fastening screw 7 is drilled. When the mounting plate 1 has been placed onto the frame 4 the fastening screw 7 is screwed into the hole 12 but is not yet tightened. Vertical adjustment, then can be effected, whereupon the mounting plate 1 is finally clamped onto the frame 4 by tightening the fastening screw 7.

In the embodiment according to FIGS. 8 to 14 a two-part base plate 13 comprising an internal centering member 14 and an external sliding member 15 is inserted into the mounting plate 1.

The internal centering member 14 has a cylindrical hole 16 through which the fastening screw 7 extends in the mounted position and is fastened to the mounting plate 1 by means of the fastening screw 7.

The centering member 14 is embraced by the sliding member 15. In the illustrated embodiment the sliding member 15 has a rectangular recess 17 within which the centering member 14 is arranged in the mounted position. The sliding member 15 is provided with a lateral flange which serves as a distance compensating plate 9 and in which is arranged a slot 18 receiving the side flange 3 of the mounting plate 1 in the mounted position. In the illustrated embodiment two projections 19 extend from the wall of the slot 18, projections 19 engaging in recesses 20 in the side flange 3, when the side flange 3 has been inserted into the slot 18. The base plate 13 thereby is locked in position on the mounting plate 1 and cannot be lost during mounting operations.

To determine the zero position for the sliding member 15 and, hence, for the entire hinge, in the embodiment the illustrated sliding member 15 is provided with a projection 21 engaging in a notch 22 in the centering member 14.

Figure 8:
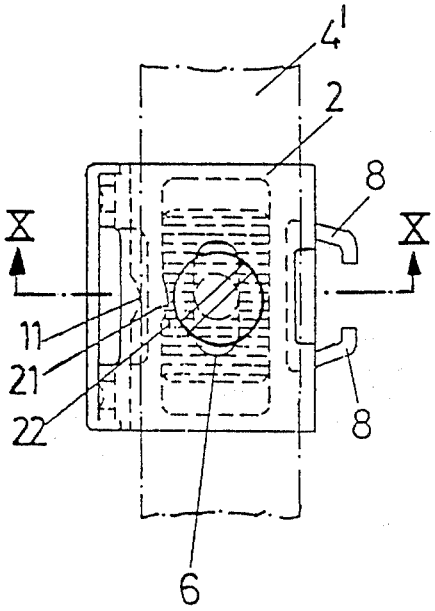
FIG. 8 is a top view of a mounting plate-base plate assembly in the beginning position.
Figure 9:
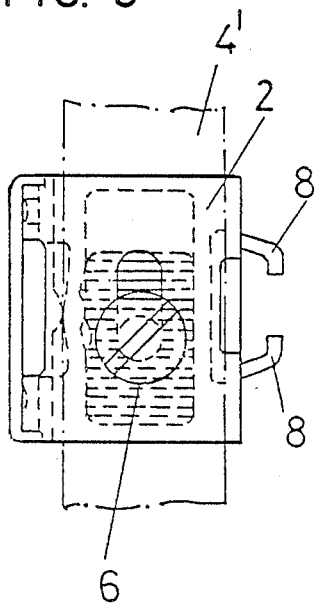
FIG. 9 is a similar top view with the mounting plate being displaced.
Figure 10:
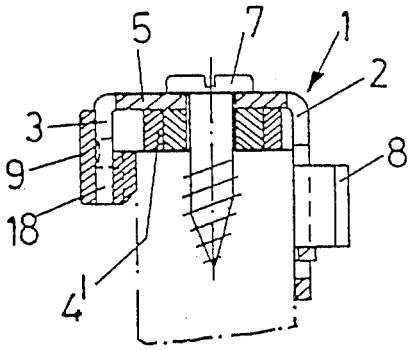
FIG. 10 is a sectional view along line X—X of FIG. 8.
Figure 11:
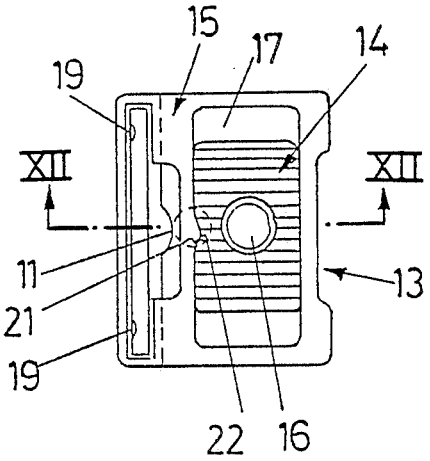
FIG. 11 is a top view of the base plate.
Figure 13:
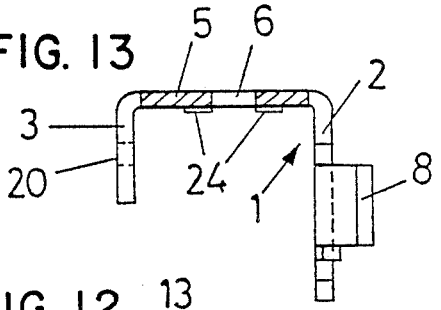
FIG. 13 shows the same sectional view of the mounting plate.
Figure 12:
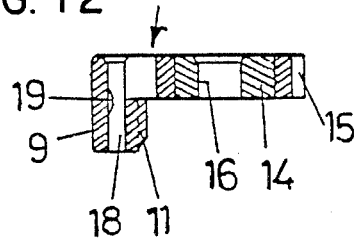
FIG. 12 is a sectional view along line XII—XII of FIG. 11.

This engaging and zero position is shown in FIG. 8. If an adjustment of the mounting plate 1 is required, then plate 1 can be displaced together with the sliding member 15 and the projection 21 is forced out of the notch 22.

The lateral flange of the sliding member 15 further has a projection 11 pressing against the frame 4 in the mounted position and, hence ensures a close fit of the assembly of mounting plate 1 and base plate 13 on the frame 4.

Figure 14:
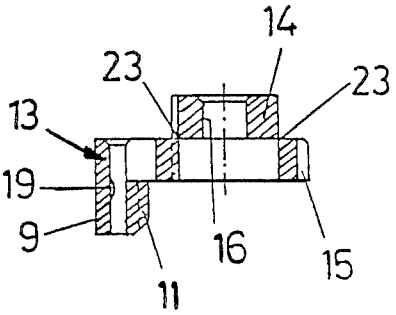
FIG. 14 is a sectional view analogous to FIG. 12, but of a modification of the base plate prior to the mounting of the hinge.

The two-part base plate 13 is advantageously manufactured, as illustrated in FIG. 14, by injection-molding such that the centering member 14 and the sliding member 15 are connected at flanges 23 which form desired breaking points and break easily when the centering member 14 is pressed into the recess 17 of the sliding member 15.

Before the mounting plate 1 and the base plate 13 are placed onto the frame 4, a hole for the fastening screw 7 is drilled into the frame 4. When the base plate 13 and the mounting plate 1 have been positioned on the frame 4, the fastening screw 7 is screwed into the hole in the frame such that the mounting plate 1 and the base plate 13 are held on the frame 4 but are not clamped thereto. If required, a vertical adjustment of the mounting plate 1 can be made in this condition. After such adjustment or if such adjustment has proved unnecessary, the mounting plate 1 and the base plate 13 are finally clamped to the frame 4 by fastening the fastening screw 7.

Projections 24 may be molded to the mounting plate 1 within the U-profile to improve the fit of the mounting plate 1 on the centering member 14.

What is claimed is:

1. A mounting plate of a hinge for mounting on a frame of an article of furniture a door of the article of furniture, said mounting plate comprising:

a member having a U-shaped configuration defined by parallel first and second side flanges adapted to extend vertically along opposite sides of a furniture frame, and a center flange connecting said side flanges and adapted to extend vertically along a front face of the frame;

said first side flange having means for supporting a hinge arm;

said second side flange including means for accommodating varying thicknesses of the frame to ensure a snug fit of said mounting plate on the frame prior to rigid attachment therebetween, said accommodating means comprising a plate member formed integrally as part of said second side flange and extending substantially coplanar with said second side flange and constructed to resiliently contact the adjacent side of the frame, said mounting plate having therein, at an edge between said center flange and said second side flange, a slot separating said center flange from said plate member; and at least one fastening screw fitting through said center flange for rigidly attaching said mounting plate to the frame.

2. A mounting plate as claimed in claim 1, wherein said screw extends through a vertically elongated slot in said center flange.

3. A mounting plate as claimed in claim 1, wherein said plate member has extending therefrom an integral projection for resilient abutment with the adjacent side of the frame.

* * * * *